US005542867A

United States Patent [19]

Hishinuma et al.

[11] Patent Number: 5,542,867

[45] Date of Patent: Aug. 6, 1996

[54] PROCESS FOR CONNECTION OF A MOLYBDENUM FOIL TO A MOLYBDENUM LEAD PORTION AND METHOD OF PRODUCING A HERMETICALLY ENCLOSED PART OF A LAMP USING THE PROCESS

[75] Inventors: Nobuyuki Hishinuma; Kenichi Hirose; Tatsushi Igarashi, all of Himeji, Japan

[73] Assignee: Ushiodenki Kabushiki Kaisha, Japan

[21] Appl. No.: 351,656

[22] Filed: Dec. 7, 1994

[30] Foreign Application Priority Data

Dec. 8, 1993 [JP] Japan ..... 5-340272

[51] Int. Cl.[6] ..... H01J 9/32; H01J 9/18

[52] U.S. Cl. ..... 445/32; 445/44; 313/332; 313/623

[58] Field of Search ..... 445/32, 48, 44; 313/332, 623

[56] References Cited

U.S. PATENT DOCUMENTS 2,158,845 5/1939 Ayer ..... 313/332

3,785,019 1/1974 Chiola et al. ..... 445/32

4,490,646 12/1984 Bunk et al. ..... 313/332

FOREIGN PATENT DOCUMENTS 375402 6/1990 European Pat. Off. ..... 313/623

*Primary Examiner*—P. Austin Bradley

*Assistant Examiner*—Jeffrey T. Knapp

*Attorney, Agent, or Firm*—Sixby, Friedman, Leedom & Ferguson, P.C.; David S. Safran

[57] ABSTRACT

A process for connecting a molybdenum foil to a lead portion with sufficient strength and reliability in which an expensive binder, such as platinum, platinum clad molybdenum, or the like, is not used. According to the invention, a carbon containing or carbon coated molybdenum part is placed between the molybdenum foil and the molybdenum lead portion and then the two are resistance welded to one another. Furthermore, a hermetically enclosed part of a lamp can be produced by this process.

6 Claims, 3 Drawing Sheets

PROCESS FOR CONNECTION OF A MOLYBDENUM FOIL TO A MOLYBDENUM LEAD PORTION AND METHOD OF PRODUCING A HERMETICALLY ENCLOSED PART OF A LAMP USING THE PROCESS

BACKGROUND OF THE INVENTION

1. Field of the Invention

The invention relates to a process for connecting a molybdenum foil to a molybdenum lead portion. The invention furthermore relates to a production process for producing a hermetically enclosed part of a lamp using the resultant connected foil and lead part.

2. Description of Related Art

Conventionally, quartz glass is often used as lamp material; however, it has a coefficient of expansion significantly different from that of the tungsten or molybdenum of which the lead pin is normally made. Therefore, to form a hermetically enclosed part, a direct hermetic enclosure of the quartz glass on the lead pin is not used, and instead, a welding of the lead pin to a molybdenum foil is performed. In this way, an electrical connection can be maintained inside and outside of the lamp.

FIG. 5 illustrates a hermetically enclosed part of a conventional filament lamp. In the representation, numeral 1 references a bulb made of quartz glass; on an end, a hermetically enclosed part 11 is formed in which molybdenum foil 4 is placed. An inner lead 3 is connected to filament 2 and the inner lead 3 and an outer lead 5 both resistance welded to molybdenum foil 4 for providing an electrical connection enabling an external source of power to be applied to the filament. Tungsten or molybdenum is used for these leads.

The molybdenum foil 4 is resistance welded to an end 31 of inner lead 3 and an end 51 of the outer lead 5 with either platinum of a relatively low melting point or molybdenum with platinum coating (platinum clad molybdenum) being disposed therebetween as a binder 7. In this binder 7, for example, the platinum clad molybdenum is formed such that a molybdenum foil 71 is coated with a platinum film 72 as shown in FIG. 6. Molybdenum foil 71 has, for example, a thickness of 28 microns, and the platinum film 72 has a thickness of 1 micron.

When, in this case, the leads and the molybdenum foil are temporarily welded directly to one another, as a result of their temperature increases, oxidation and nitration occur, and mechanical strength decreases even if welding is achieved. In particular, in the molybdenum foil, due to a small tensile force, holes can be formed since its temperature rises slightly due to its small thickness.

The molybdenum and the tungsten which comprise the leads are formed as pins of sintered metals and consist of fine crystal grains which adhere to one another when they are exposed to a high temperature. This phenomenon is usually called recrystallization, by which the lead pins consisting of the fine crystal grains change into lead pins consisting of large crystal grains. According to this change, the lead pins are inherently fragile, and mechanical strength, likewise, decreases.

For these reasons, instead of direct welding, a binder is used, whereby the platinum with a low melting point is melting first as the binder, and thus, the molybdenum foil and the lead pins are able to be joined to one another. This means that, when using the binder, less electrical energy can be used in welding. Therefore, the temperature rise of the molybdenum foil and the lead pins can be reduced, and thus, nitration and oxidation of the above-described molybdenum foil and above-described lead pins is prevented along with an associated reduction of mechanical strength due to recrystallization.

In addition, the temperature rise of the molybdenum foil and the lead pins is reduced by removing the electrical energy of welding through the binder, such as a platinum foil or the like. In this way, adhesion of the molybdenum foil and the lead pins to the welding electrode rods during welding is prevented, and the advantage is gained that welding can be done in a relatively simple manner.

However, in this case, it is considered disadvantageous that platinum is an expensive precious metal and thus raises costs. Furthermore, there is the disadvantage that, as the result of different coefficients of expansion of the platinum and quartz glass which comprises the bulb, cracking occurs in hermetically enclosed part 11.

Proceeding from the above-described circumstances, different measures are known, for example, from the published Japanese utility model SHO 53-13251 and Japanese patent SHO 63-40354, in which the molybdenum foil and the lead portions are welded directly to one another without using a binder, such as platinum, platinum clad molybdenum or the like. By means of the measures disclosed therein, an attempt is made to reducc the contact area of the molybdenum foil with the lead portions and to increase welded strength by intensification of a welding current by changing the shape of the lead portion.

However, in these measures, it is considered disadvantageous that the mechanical strength is less as compared to using a binder, such as platinum, platinum clad molybdenum or the like, and that the phenomenon of nitration, oxidation and recrystallization occurs in the molybdenum foil and lead pins as the result of increasing the welding current for purposes of increasing the strength.

In particular, in the case of manufacturing a filament lamp with bilateral hermetic seals, the two ends of a filament assembly which formed of an inner lead, a molybdenum foil for purposes of hermetic enclosure, and an outer lead, are hermetically sealed by exerting a tensile force on the ends of the filament assembly during heating of the quartz bulb. It is, therefore, necessary to weld the inner lead and the outer lead to the molybdenum foil for purposes of hermetic enclosure with high mechanical strength.

SUMMARY OF THE INVENTION

Therefore, a primary object of the present invention is to devise a process for connecting a molybdenum foil to a lead portion with sufficient strength and reliability in which an expensive binder, such as platinum, platinum clad molybdenum or the like, is not used, so to eliminate the above-described disadvantages.

This object is achieved according to a preferred embodiment of the invention by placing a carbon-molybdenum part between the above-described molybdenum foil and the above-described molybdenum lead portion by resistance welding, and by resistance welding the two to one another in a process for connecting a molybdenum foil to a molybdenum lead portion.

The object of the invention is furthermore achieved, advantageously, by forming the above-described carbon-molybdenum part such that the molybdenum part is coated with carbon.

The object of the invention is also achieved, advantageously, by the above-described carbon-molybdenum part containing carbon with a weight of greater than/or equal to 30 ppm.

Moreover, the object of the invention is achieved, advantageously, by forming a molybdenum carbide layer on one surface of the molybdenum part in the above-described carbon-molybdenum part.

According to the invention, using the molybdenum foil and the molybdenum part which are joined to one another by the process according to the invention for connection, a hermetically enclosed part of a lamp can be produced.

Additionally, it is advantageous to use this connection body for producing a hermetically enclosed part of a filament lamp with bilateral, hermetic seals.

In the above-described process, between the molybdenum foil and the molybdenum lead portion, there is a carbon-molybdenum part as a binder. Carbon generally has high electrical resistance. The temperature in resistance welding is, therefore, maximally high in the carbon-molybdenum part used as a binder, and by melting this molybdenum binder part, welding of the molybdenum foil to the molybdenum lead portion is achieved.

It was found that, in this case, the molybdenum foil and the molybdenum lead portion can be welded tightly to one another, and because of the presence of carbon, embrittlement is prevented. The reason for this is certainly not entirely clear; however, presumably, it lies in the fact that, due to a higher melting point of the carbon than the molybdenum, the molybdenum is necessarily recrystallized at a temperature at which the carbon is melted, as described above, and that in spite of the assumption that embrittlement is even more accelerated thereby, the carbon penetrates between the recrystallizing molybdenum particles and in this way greater, strength is obtained in contrast.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 1:
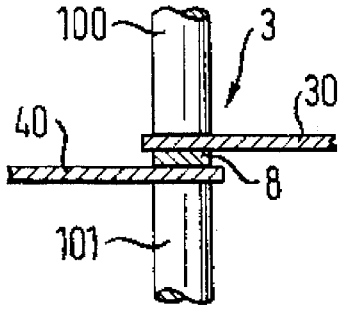
FIG. 1 is a schematic representation of a process for resistance welding of a molybdenum foil for purposes of hermetic enclosing a lead portion.

With reference to FIG. 1, a process for welding a lead portion 30 to a molybdenum foil 40 for purposes of producing a hermetic enclosure part of lamp in accordance with the present invention will be described. Between a pair of welding electrodes 100, 101, the molybdenum foil 40 and molybdenum lead 30 are clamped with a molybdenum foil that is surface coated with carbon being disposed therebetween as a molybdenum connection part which is hereinafter referred to as "binder 8". Proceeding from this state, power is supplied to the electrodes 100, 101 on which a pressing force is exerted, and by melting of the binder 8, welding is effected.

Specifically, first, in a state in which the electrodes 100, 101 are separated from one another, a molybdenum hermetic sealing foil 40 on which binder 8 is applied, by means of tweezers or the like, on which, furthermore, a welded part of inner lead 3 is seated is disposed above lower electrode 101. Then, in the state shown in FIG. 1, so-called resistance welding is performed by lowering upper electrode 100. The surface available for seating binder 8 on electrode 101 is relatively small and is for example 2 $mm^2$, since this resistance welding is a local welding. Therefore, molybdenum hermetic sealing foil 40 can also be temporarily cemented, beforehand, to the binder 8, and then resistance welding as described above.

In addition, in the case in which outer lead 5 is a molybdenum lead, for welding molybdenum hermetic sealing film 40 to outer lead 5, welding can be performed by placing the binder 8 between them, as is described above.

In the following, numerical values for this process are given by way of example:

The power supplied to the electrodes 100, 101 is 30 W/sec. The welding pressure is 0.5 kg, the diameter of the molybdenum lead portion 30 is 0.4 mm, the thickness of molybdenum hermetic sealing film 40 is 0.03 mm and the thickness of the molybdenum binder 8 is 0.03 mm. The temperature of this molybdenum binder 8 rises to 2700° C.

In this process, for welding of the molybdenum film to the lead portion, the advantage arises that the process can be executed without using a costly binder, such as platinum or platinum molybdenum foil, i.e., without high cost. In addition, by using the carbon-containing binder, a strong weld of molybdenum foil to the lead portion can be obtained.

In this embodiment, a molybdenum binder part in the form of a foil was described for producing the welded connection. However, this part need not always be a foil, and a wire can also be used, as is described below. In such a case, a surface of the molybdenum wire can be coated with carbon.

Figure 2:
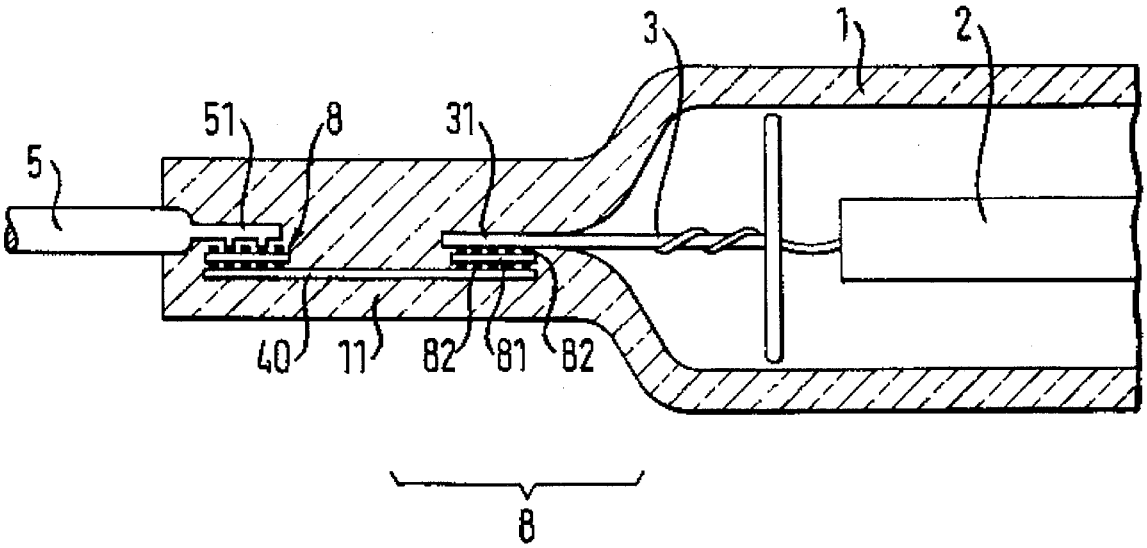
FIG. 2 is a schematic representation of a hermetically enclosed part of a halogen filament lamp according to the invention.

FIG. 2 schematically shows a portion of hermetically enclosed parts of a halogen filament lamp with bilateral, hermetic seals using the connected molybdenum foil and lead which are produced by the above-described process. In this halogen filament lamp, both the inner lead 3 and the outer lead 5 are formed of molybdenum.

Filament 2 is located within bulb 1 along its longitudinal axis and is connected to inner lead 3 in the vicinity of an end of the bulb 1. The molybdenum hermetic sealing foil 40 is inserted in the hermetically enclosure part 11 of bulb 1, and the end 31 of the inner lead 3 and end 51 of the outer lead 5 are connected via binder 8 by welding. Binder 8 has a carbon layer 82 (which is represented by a broken line) formed on the molybdenum foil 81 at opposite sides thereof.

In this case, an assembly in which filament 2, inner lead 3, molybdenum hermetic sealing foil 40 and outer lead 5 are connected to one another into a filament assembly. Within bulb 1, for example, a gas, such as argon or the like, which contains 0.01 percent by volume chlorine, is encapsulated with a pressure of 650 torr.

The filament assembly is heated after assembly by the above-described welding and then its surface is cleaned using a cleaning liquid in a heating furnace with a hydrogen atmosphere. During this heating, a suitable amount of carbon which was applied to the binder is diffused also within molybdenum hermetic sealing foil 40. By means of this diffusion, the welded strength of the filament assembly can be intensified even more.

The filament assembly is located within a quartz tube, and after externally hearing a part in which the molybdenum hermetic sealing foil 40 is located, the hermetically enclosed part 11 is formed by surface pressing by means of a device for hermetic enclosure.

The hermetically enclosed part of the halogen filament lamp is formed in the above-described manner. Carbon layer 82 formed on the surface of binder 8 has in particular a reinforcing effect on welded strength of the lead portion to molybdenum foil 40 for purposes of hermetic sealing. In a halogen filament lamp with bilateral hermetic seals in which a hermetically enclosed part is formed such that a tensile force is exerted as described above, it is, therefore, especially effective to use the filament assembly according to the invention.

Figure 3:
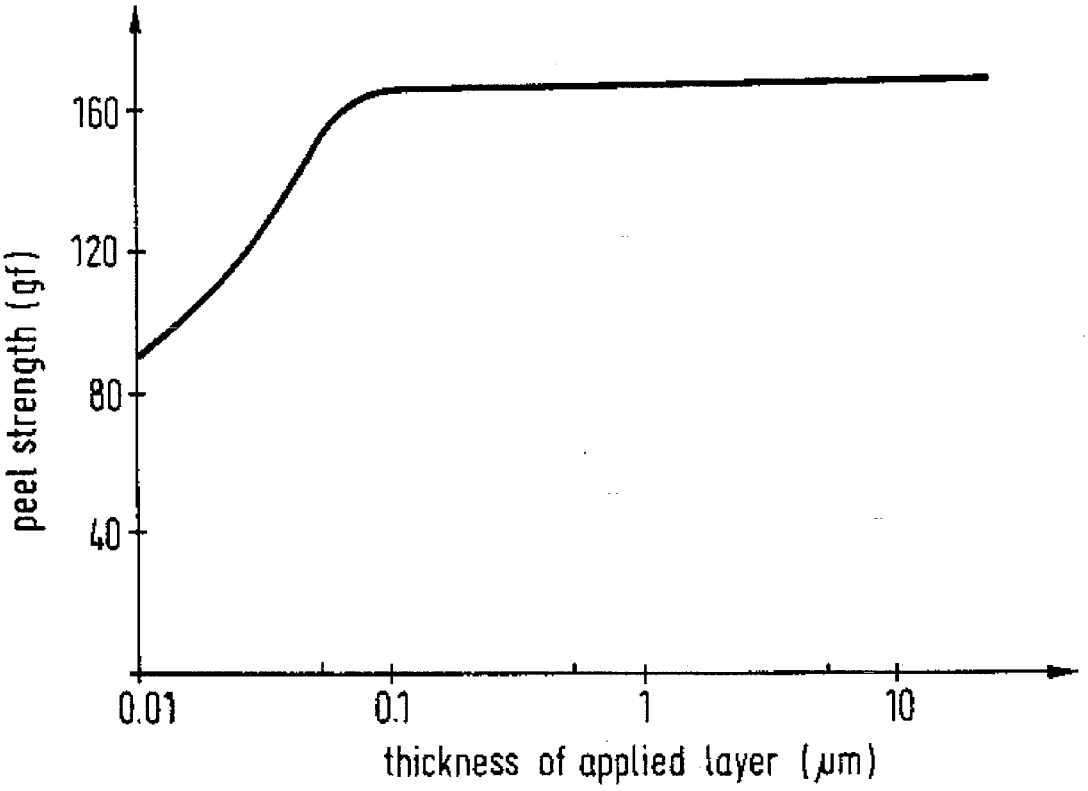
FIG. 3 graphically depicts the relationship between layer thickness of applied carbon and peel strength.

FIG. 3 shows the relationship between the thickness of the carbon layer 82 applied to the surface of binder 8 and the welded strength when the molybdenum foil is welded to the lead portion using this binder 8. A test was performed in which the breaking strength of a welded part was determined when outer lead 5 was aligned vertically and attached, and at the same time, the molybdenum hermetic sealing foil 40 was pulled in a direction perpendicular to outer lead 5. In the figure the term "peel strength" will be defined as this breaking strength. A peel strength for example of roughly 90 gf at a thickness of the applied layer of 0.01 microns, therefore, means that molybdenum foil 40 and outer lead 5 come loose at a tensile force of 90 gf.

In the figure, the peel strength is increased according to an increase of the thickness of the applied layer, and beginning at roughly 0.1 microns layer thickness, the peel strength is an essentially constant value of roughly 165 gf. It becomes apparent from this test that the welded strength does not change if the thickness of the carbon layer is increased beyond a value of at least 0.1 microns. On the other hand, if the thickness of the carbon layer is unnecessarily increased, the disadvantage arises that the carbon of the binder splashes during welding and holes are formed in the molybdenum hermetic sealing foil 40. The optimum thickness of the carbon layer is usually 0.2 to 15 microns.

If, as an illustration, the molybdenum foil and the lead portion are welded directly to one another without binder 8, the molybdenum foil and the lead portion detach at a peel strength of roughly 50 gf.

In the following, production of binder 8 is described. A carbon liquid to be applied to the surface of binder 8 is produced such that a fine carbon powder together with a tenside of an organic compound is suspended or dispersed in a thin ammonia water. A commercial product for example can be used for this purpose. By immersing a strip-like molybdenum part into this liquid or by atomization, application by means of a paint brush or electrostatic application to the molybdenum part, the surface of the molybdenum part can be coated. Since it is wet after application of the liquid, the molybdenum part must be air dried, after which it is thinly cut.

In addition, not only can a strip-like molybdenum foil be coated with the carbon, but the carbon can likewise be applied to a thin molybdenum wire. The term "molybdenum connection part" is, therefore, defined not only as a molybdenum foil, but also a molybdenum wire.

The embodiments described above relate to a molybdenum connection part for connection with a surface which is coated with carbon. However, a binder can also be used in which the molybdenum contains carbon. In this case as well, the carbon contained in the binder has the function of preventing embrittlement of molybdenum hermetic sealing foil 40.

Figure 4:
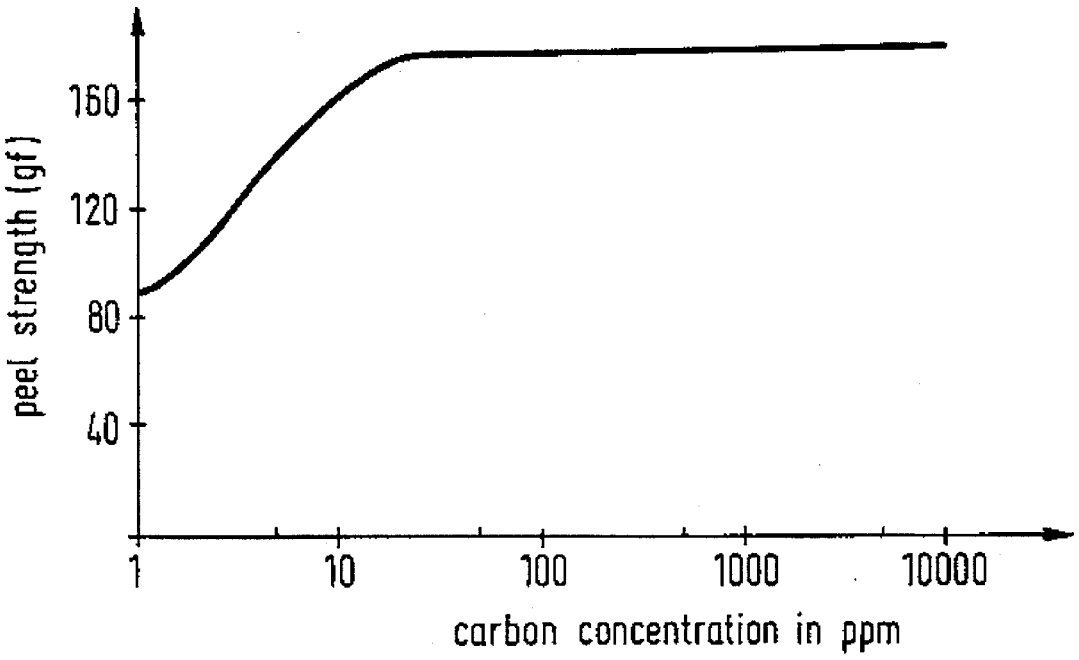
FIG. 4 graphically depicts the relationship between the carbon content of the molybdenum foil used as a binder and the peel strength.
Figure 5:
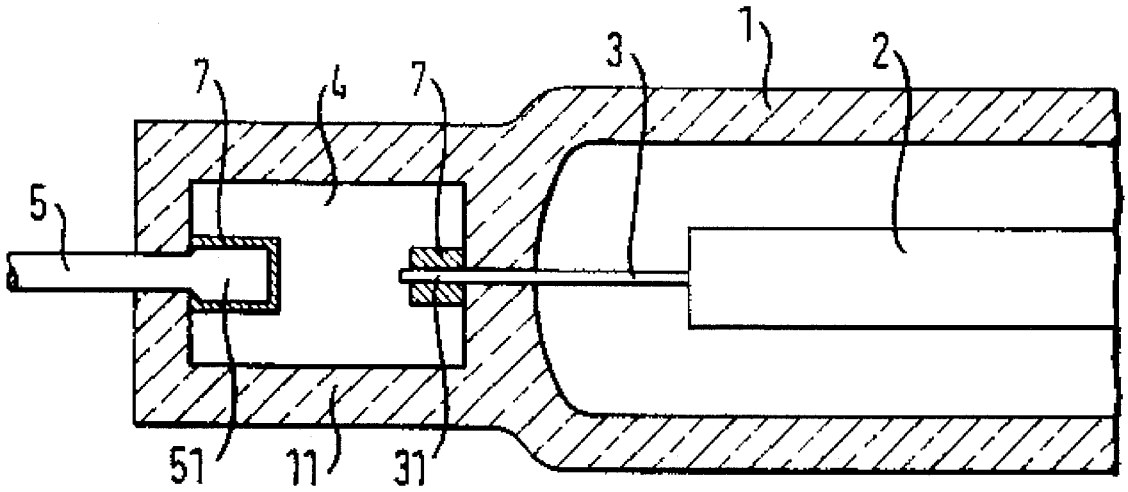
FIG. 5 (PRIOR ART)
FIG. 5 is a schematic representation of a hermetically enclosed part in a conventional halogen filament lamp.
Figure 6:
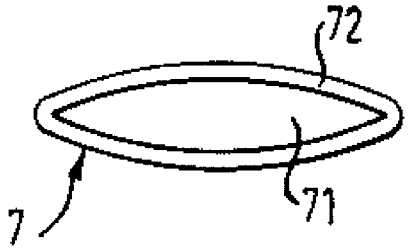
FIG. 6 (PRIOR ART)
FIG. 6 is a schematic depiction of a foil of platinum clad molybdenum.

The binder which contains the carbon has the same effect as the binder on whose surface the carbon has been applied. However, it has the advantage that, during handling, the danger of detachment of the carbon coating or similar problems do not arise, and therefore, it can be easily used, FIG. 4 shows the relationship between the carbon concentration of the molybdenum binder part which contains carbon and the weld strength in welding the molybdenum foil to the lead portion using this binder. The test was run in the same way as the process described relative to FIG. 3. However, welding bodies of molybdenum foils and outer leads were produced using binders with different carbon concentrations, and the test was run in series for each welding body.

It becomes clear from FIG. 4 that the peel strength then has an essentially constant value if the carbon content relative to the molybdenum foil as a whole is greater than or equal to 30 ppm. This indicates that, with respect to weld strength, it is effective to use a binder in which the carbon content relative to the molybdenum foil as a whole comprises at least 30 ppm.

Furthermore, another embodiment is described below in which a molybdenum carbide layer is formed as the binder on the surface of the molybdenum foil. One such binder can, for example, be easily produced by a hydrogen gas which contains benzene vapor being allowed to flow into a thin tube consisting of quartz glass, a strip of molybdenum is passed into it, and in doing so, the hydrogen flow from the vicinity of the thin quartz glass tube is heated. The desired layer thickness of the carbide can of course be easily maintained by regulating the temperature and duration of heating.

In FIG. 2 it was described that the filament assembly produced by the process according to the invention for connecting the molybdenum foil to the molybdenum lead portion can be used for a halogen filament lamp with bilateral, hermetic seals. This was, however, described only by way of example since such a lamp in the production of its hermetically enclosed part needs high welded strength, and the filament assembly can be used not only for this type of lamp, but also for a lamp with a unilateral, hermetic seal or a discharge lamp.

As was described above, by means of the process according to the invention, for connecting the molybdenum foil to the molybdenum lead portion for purposes of producing a hermetic enclosure, the embrittlement of the molybdenum hermetic sealing foil and of the molybdenum lead portion can be prevented and the molybdenum hermetic sealing foil and the molybdenum lead portion can be connected to one another with a high weld strength even if resistance welding is performed without using an expensive binder, such as platinum foil or the like.

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. Process for connecting a molybdenum foil to a molybdenum lead portion, comprising the steps of: disposing a carbon-molybdenum binder part between the molybdenum foil and the molybdenum lead portion and then resistance welding the molybdenum foil to the molybdenum lead portion at said binder part.

2. Process for connecting a molybdenum foil to a molybdenum lead portion according to claim 1, wherein the carbon-molybdenum part is formed by coating a molybdenum part with carbon.

3. Process for connecting a molybdenum foil to a molybdenum lead portion according to claim 1, wherein a molybdenum part containing at least 30 ppm of carbon is used as the carbon-molybdenum part.

4. Process for connecting a molybdenum foil to a molybdenum lead portion according to claim 1, wherein the carbon-molybdenum part is formed by coating a surface of a molybdenum part with a molybdenum carbide layer.

5. Process for producing a hermetically sealed part of a lamp, comprising the steps of: forming a connection part by disposing a carbon-molybdenum binder part between a molybdenum foil and a molybdenum lead portion and then resistance welding the molybdenum foil to the molybdenum lead portion at said binder part; placing the connection part in an end of hollow quartz glass member; and forming a hermetically sealed part by the application of heat and pressure to the end of a hollow quartz glass member to form a thermal pressure connection therewith.

6. Process for producing a hermetically enclosed part of a lamp according to claim 5, wherein a said hermetically sealed part is provided at each of opposite ends of a quartz glass tube forming the quartz glass member to produce a filament lamp with bilateral, hermetic seals.

* * * * *